US009241573B1

(12) United States Patent
Tsai

(10) Patent No.: US 9,241,573 B1
(45) Date of Patent: Jan. 26, 2016

(54) RESILIENT-SUPPORT ADJUSTING DEVICE OF CHAIR BACKREST

(71) Applicant: Zhongshan Shi Songlin Furniture Co., Ltd, Zhongshan, Guangdong Prov. (CN)

(72) Inventor: Hsuan-Chin Tsai, Chai-Yi Hsien (TW)

(73) Assignee: Zhongshan Shi Songlin Furniture Co., Ltd., Zhongshan (CN)

( * ) Notice: Subject to any disclaimer, the term of this patent is extended or adjusted under 35 U.S.C. 154(b) by 0 days.

(21) Appl. No.: 14/520,405

(22) Filed: Oct. 22, 2014

(51) Int. Cl.

| | |
|---|---|
| ***A47C 3/00*** | (2006.01) |
| ***B60N 2/02*** | (2006.01) |
| ***A47C 7/44*** | (2006.01) |
| ***A47C 1/024*** | (2006.01) |
| *A47C 1/032* | (2006.01) |

(52) U.S. Cl.
CPC ..... *A47C 7/443* (2013.01); *A47C 1/024* (2013.01); *A47C 1/032* (2013.01); *A47C 1/03255* (2013.01); *A47C 1/03261* (2013.01); *A47C 1/03266* (2013.01); *A47C 1/03272* (2013.01)

(58) Field of Classification Search
CPC ..... A47C 1/03272; A47C 1/03255; A47C 1/03261; A47C 1/03266; A47C 1/032
USPC ..... 297/301.4, 300.5, 354.1, 383, 299, 292, 297/353, 285; 248/161, 560
See application file for complete search history.

(56) References Cited

U.S. PATENT DOCUMENTS 3,601,444 A * 8/1971 Doerner ..... A47C 1/027 248/575
5,951,109 A * 9/1999 Roslund, Jr. ..... A47C 1/03255 297/299
6,361,110 B2 * 3/2002 Roslund, Jr. ..... 248/161
6,588,843 B1 * 7/2003 Ebenstein ..... A47C 1/03238 297/300.1
7,467,826 B1 * 12/2008 Wen ..... A47C 1/03255 297/300.8
7,946,651 B2 * 5/2011 Donati ..... A47C 1/025 297/285
8,100,477 B2 * 1/2012 Fich ..... A47C 1/03255 297/289
8,528,973 B2 * 9/2013 Sander ..... A47C 1/03255 297/300.5
2007/0057552 A1 * 3/2007 Roslund ..... A47C 1/03222 297/292
2015/0123441 A1 * 5/2015 Duke ..... A47C 1/03255 297/300.4

FOREIGN PATENT DOCUMENTS

| | | |
|---|---|---|
| TW | M321261 U | 11/2007 |
| TW | M395420 U | 1/2011 |
| TW | I429411 B | 3/2014 |
| TW | M480321 U | 6/2014 |

* cited by examiner

*Primary Examiner* — Chi Q Nguyen
(74) *Attorney, Agent, or Firm* — Alan D. Kamrath; Kamrath IP Lawfirm, P.A.

(57) ABSTRACT

A resilient-support adjusting device of a chair backrest includes a base and a spring-tensioning brace and a backrest-fastening seat pivotally connected to two ends of the base. The backrest is fixed to the backrest-fastening seat. A spring is tensioned between the spring-tensioning brace and the backrest-fastening seat. The base contains upper and lower abutting members that have inclined abutting surfaces abutting against each other. The upper abutting member has an upper end abutting against a swinging end of the spring-tensioning brace. The lower abutting member has an engaging member that can be driven by the operating lever to rotate. The engaging member and the lower abutting member engage with each other. When rotated, the operating lever drives the spring-tensioning brace to swing and draw the spring. The spring thus draws the backrest-fastening seat harder, making the backrest have stronger backward resilient support.

6 Claims, 5 Drawing Sheets

RESILIENT-SUPPORT ADJUSTING DEVICE OF CHAIR BACKREST

BACKGROUND OF THE INVENTION

1. Technical Field

The present invention relates to chairs and more particularly to a resilient-support adjusting device of a chair backrest. The resilient-support adjusting device includes a base and a spring-tensioning brace and a backrest-fastening seat pivotally connected to two ends of the base. A spring is tensioned between the spring-tensioning brace and the backrest-fastening seat. The base contains upper and lower abutting members that have inclined abutting surfaces abutting against each other. The upper abutting member has an upper end abutting against a swinging end of the spring-tensioning brace. The lower abutting member has an engaging member that can be driven by the operating lever to rotate. The engaging member and the lower abutting member engage with each other. When rotated, the operating lever drives the spring-tensioning brace to swing and draw the spring. The spring thus draws the backrest-fastening seat harder, making the backrest have a stronger backward resilient support.

2. Description of Related Art

In existing office chairs, the backrest is typically provided with a resilient-support mechanism. For example, Taiwan Patent Nos. TWI429411 (B), TWM395420 (U), TWM321261 (U) and M480321 (the same invention as claimed in China Patent No. CN201320493667) all disclose resilient-support mechanisms using a spring to draw or prop up a lower end of a swinging backrest, so that the resilient compressing force of the spring can endow the backrest with resilient support. These patents also have common operational means wherein a rotatable screw uses its threads to drive a slidable or swingable member to displace, to press or release the spring, making the spring have different levels of returning force, and in turn providing different levels of resilient support to the backrest.

While the known means achieved by the screw does support step-less adjustment of resilient support, in practical use, such step-less adjustment fails to provide a well perceptible difference. That is, by rotating the screw for two to three rounds, the pressing or releasing movement that the screw applied to the spring is too slight for a sitter sitting in the chair to feel the change in the resilient support. A difference perceptible at the backrest by the sitter can only appear when the screw is rotated for more than five rounds. It is very likely that, after repeated operation and test, the sitter has already forgotten how many rounds he/she made to the screw. When the next time he/she sits this chair, the repeated operation and test have to be performed again. This makes the adjustment highly inconvenient.

In addition, the level of resilient support of backrests is determined by the number of the rounds the screw is rotated. To make the change of the resilient support perceptible, the screw has to be rotated for many rounds. In this case, the operator has to continuously rotate the screw, making the operation effort-consuming and time-consuming. Thus, the known approach to adjustment is less capable of meeting a sitter's needs of different levels of resilient support.

BRIEF SUMMARY OF THE INVENTION

Hence, for solving the problem about the prior-art screw-based step-less adjustment of the known resilient-support adjusting devices of chair backrests, and for making adjustment of resilient support more convenient, less time consuming and less effort consuming, the present invention provides a resilient-support adjusting device of a chair backrest. The adjusting device has a base, a backrest-fastening seat pivotally connected to a rear side of the base and configured for the backrest to be fixed thereto, and a spring-tensioning brace whose lower end is pivotally connected to a front side of the base. A spring is hung and tensioned between the backrest-fastening seat and the spring-tensioning brace. The base, below an opposite end of the spring-tensioning brace, contains upper and lower abutting members that have inclined abutting surfaces corresponding and abutting against each other. The upper abutting member has an upper end abutting against the corresponding swinging end of the spring-tensioning brace. The lower abutting member has a lateral side provided with an engaging member that can be driven by the operating lever to rotate and has a toothed portion to engage with the toothed portion of the lower abutting member. When rotated, the engaging member pushes or releases the lower abutting member to displace, thereby driving the upper abutting member to move up and down, and driving the spring-tensioning brace to swing front and back, to make the spring draw the backrest-fastening seat with different levels of tension, thereby allowing the backrest to adjust the backward resilient support.

The technical scheme implemented by the present invention is to provide a resilient-support adjusting device to be installed onto a backrest of an office chair, with the resilient-support adjusting device comprising a base mounted on a gas spring of a leg portion of the office chair, and a backrest-fastening seat pivotally connected to a rear side of the base and configured for a backrest to installed thereon. The backrest-fastening seat is drawn by a spring to make the backrest generate a resilient support. The base has a front side pivotally connected to one end of a spring-tensioning brace, and the spring has an end opposite to its end that draws the backrest-fastening seat hung at a center of the spring-tensioning brace. The base corresponding to an opposite end of the spring-tensioning brace contains upper and lower abutting members that have inclined abutting surfaces abutting against each other. The upper abutting member has an upper end abutting against the corresponding end of the spring-tensioning brace, and the lower abutting member has an engaging member formed at a lateral surface thereof to be received in the base to allow the two to abut against each other. Toothed portions are provided at where the two abut against each other and are configured to engage with each other or abut against each other upon rotation of the engaging member, to displace the lower abutting member and move the upper abutting member vertically, thereby driving the spring-tensioning brace to swing front and back, and making the spring to draw the backrest-fastening seat with different levels of tension.

In the foregoing scheme, the base contains a receiving recess for receiving the upper and lower abutting members, and for guiding the lower abutting member to slide front and back and guiding the upper abutting member to slide up and down.

In the foregoing scheme, the upper abutting member has a back side provided with a guiding groove, and the receiving recess has a wall provided with a guiding ridge that corresponds to and matches the guiding groove.

In the foregoing scheme, the inclined abutting surfaces of the upper abutting member and the lower abutting member are provided with corresponding guiding ridges and guiding grooves that match and are slidable with respect to each other.

In the foregoing scheme, the toothed portions of the engaging member and the lower abutting member are provided, at a tooth top and a tooth valley, respectively, with a raised portion and a depressed portion that engage with and are positioned by each other.

In the foregoing scheme, the engaging member has an outer surface provided with a rabbet, and an operating lever is inserted into the base, the engaging member and the lower abutting member. An engaging rod is radially inserted into the operating lever and received in the rabbet.

The beneficial effects of the present invention is that the rotation of the operating lever drives the engaging member to push or release the lower abutting member to displace front and back, thereby driving the upper abutting member to move up and down and pushing the spring-tensioning brace to swing, to make the spring draw the backrest-fastening seat with different levels of tension, in turn allowing the backrest to adjust the backward resilient support. As a result, the adjustment is simplified and more capable of meeting a sitter's needs of different levels of resilient support.

DETAILED DESCRIPTION OF THE INVENTION

Figure 1:
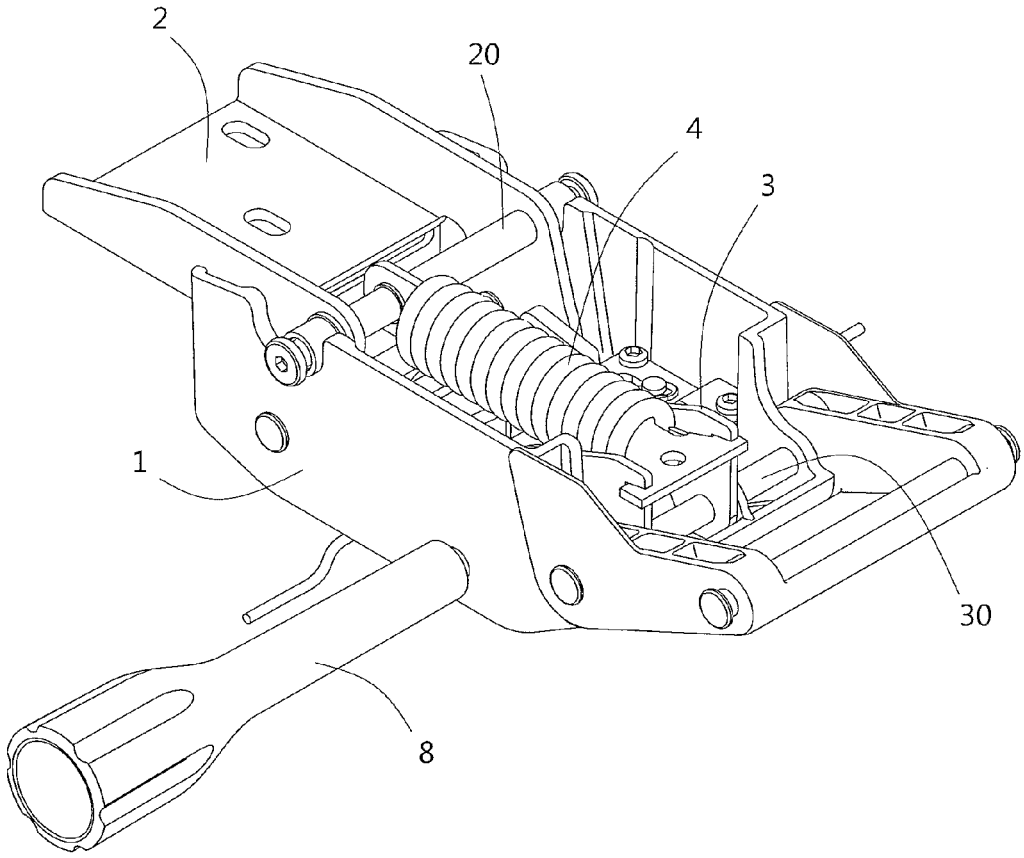
FIG. 1 is a perspective view of the present invention.
Figure 2:
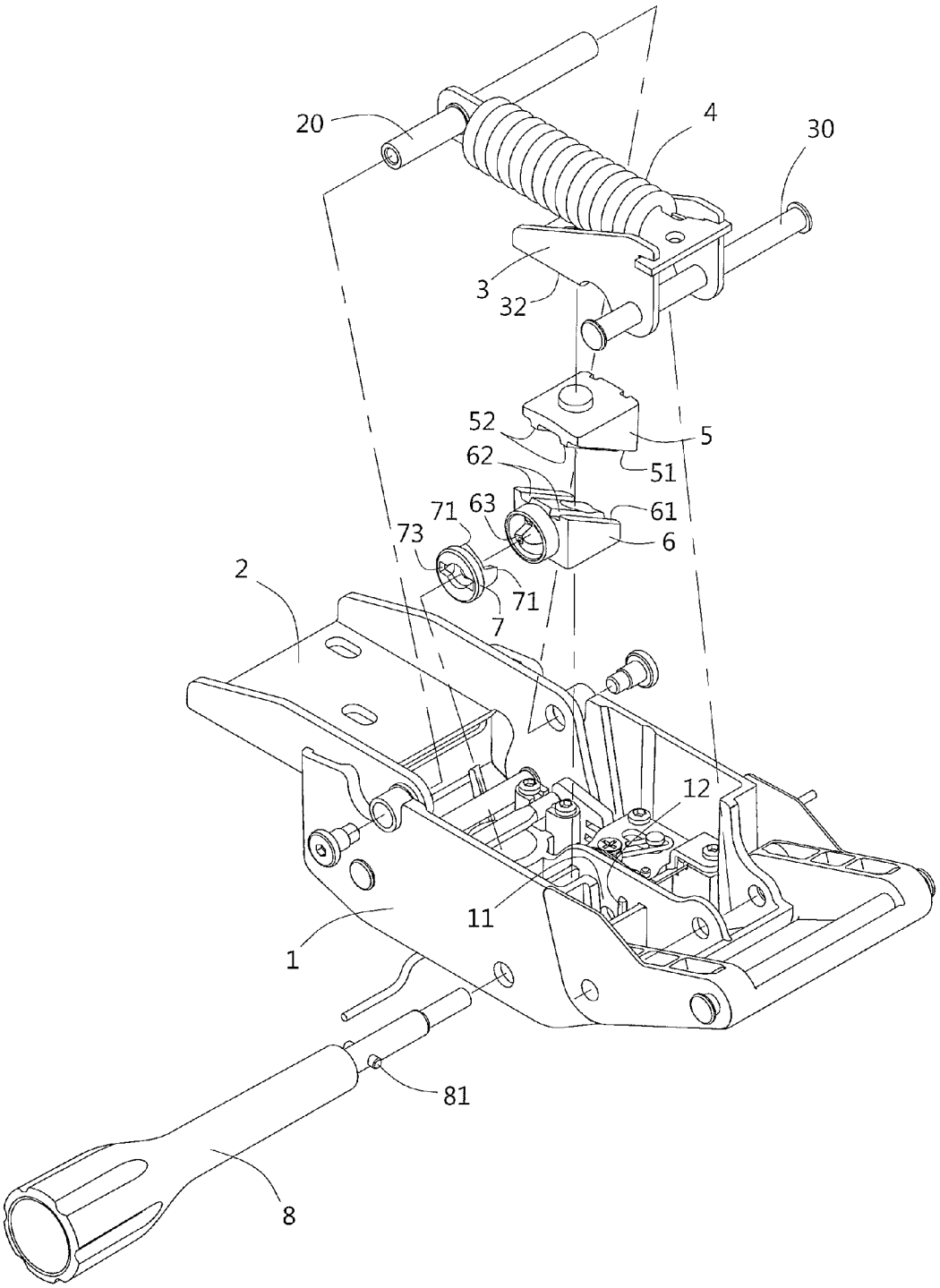
FIG. 2 is an exploded view of the present invention.

Please refer to FIG. 1 and FIG. 2. The present invention is a resilient-support adjusting device of a chair. The disclosed device comprises a base 1 whose bottom is mounted on a gas spring connected to a leg portion of the chair, and whose front and rear sides are for a seat cushion and a backrest to be installed thereon, respectively. In addition to the base 1, the disclosed device further comprises an L-shaped backrest-fastening seat 2 that has one end pivotally connected the rear side of the base 1 and has an opposite end for the backrest to be fixed thereto, and an L-shaped spring-tensioning brace 3 that has one end pivotally connected to the front side of the base 1 through a pivot 30. A spring 4 can be tensioned between a shaft 20 mounted on the backrest-fastening seat 2 and a pair of retaining notches 31 formed on the spring-tensioning brace 3 to allow the backrest-fastening seat 2 and the spring-tensioning brace 3 to swing inward oppositely.

Figures 3, 4:
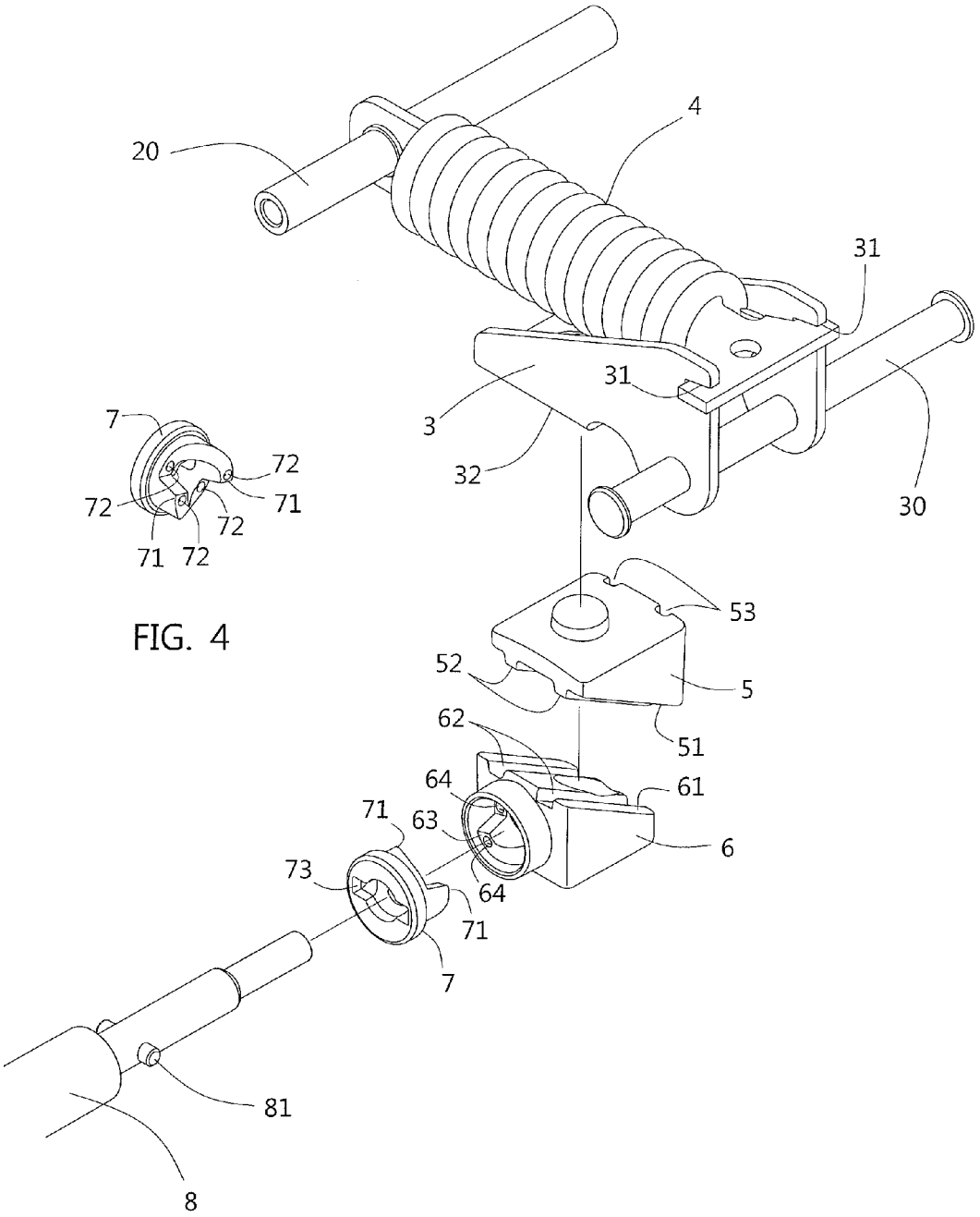
FIG. 3 is an exploded view of a resilient-support adjusting device according to the present invention.
FIG. 4 is a perspective view of an engaging member of the resilient-support adjusting device of the present invention.
Figure 5:
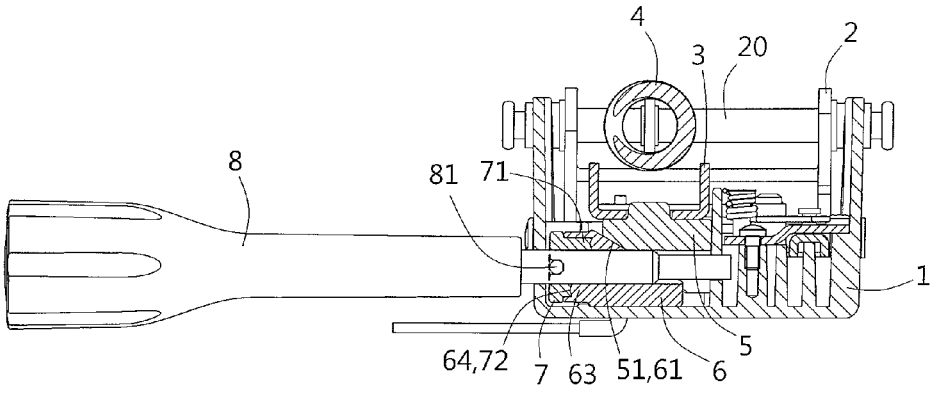
FIG. 5 is a front cross-sectional view of the resilient-support adjusting device of the present invention.
Figure 6:
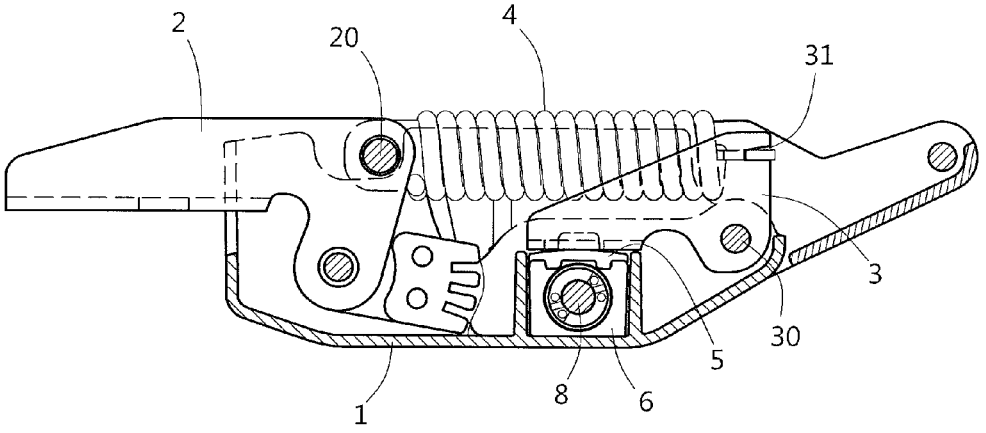
FIG. 6 is a side cross-sectional view of the resilient-support adjusting device of the present invention.

Please refer to FIG. 3 and FIGS. 5 through 6. The base 1 has a receiving recess 11 positionally corresponding to one end of a lower surface 32 of the spring-tensioning brace 3. The receiving recess 11 receives an upper abutting member 5 and a lower abutting member 6 stacked together. The upper abutting member 5 and the lower abutting member 6 abut against each other with their respective, matching, inclined abutting surfaces 51, 61. The two inclined abutting surfaces 51, 61 are provided with guiding grooves 62 and matching guiding ridges 52 and are slidable with respect to each other. The upper abutting member 5 has its upper end abutting against the lower surface 32 at the corresponding end of the spring-tensioning brace 3. The upper abutting member 5 has its back side provided with guiding grooves 53 that match and are slidable with respect to guiding ridges 12 formed on the wall of the receiving recess 11. Additionally, the lower abutting member 6 has a tapered-wedge-like, continuous toothed portion 63 depressed from a lateral surface thereof. An engaging member 7 is received in the receiving recess 11 and corresponding to the lateral surface of the lower abutting member 6. The engaging member 7 also has a toothed portion 71 (as shown in FIG. 4) that is configured to engage with the toothed portion 63 of the lower abutting member 6. The two toothed portions 63, 71 are provided with a raised portion 64 and a depressed portion 72 at their tooth top and tooth valley, respectively, for engaging with each other. The engaging member 7 has a rabbet 73 depressed from an outer surface thereof. An operating lever 8 thus can be inserted from base 1 to pass through the engaging member 7, and pass through the lower abutting member 6. An engaging rod 81 is radially inserted into the operating lever 8 to be fittingly received in the rabbet 73 of the engaging member 7.

Figure 7:
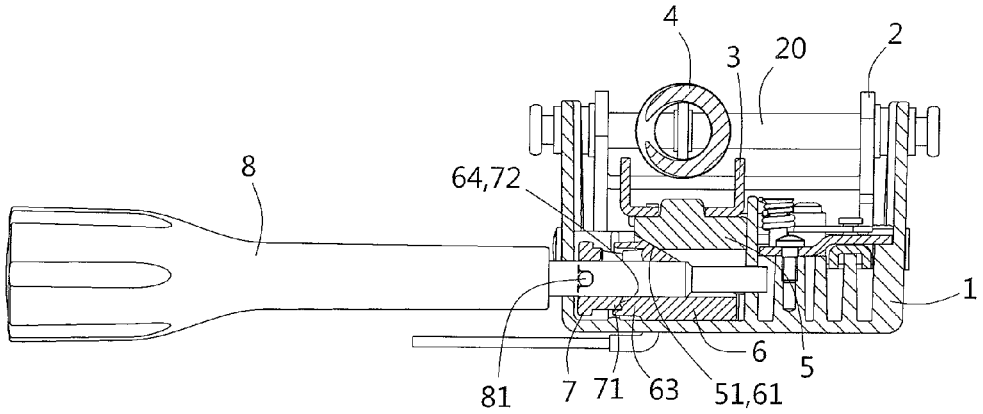
FIG. 7 is a schematic drawing showing an operating lever of the resilient-support adjusting device of the present invention pushed inward.
Figure 8:
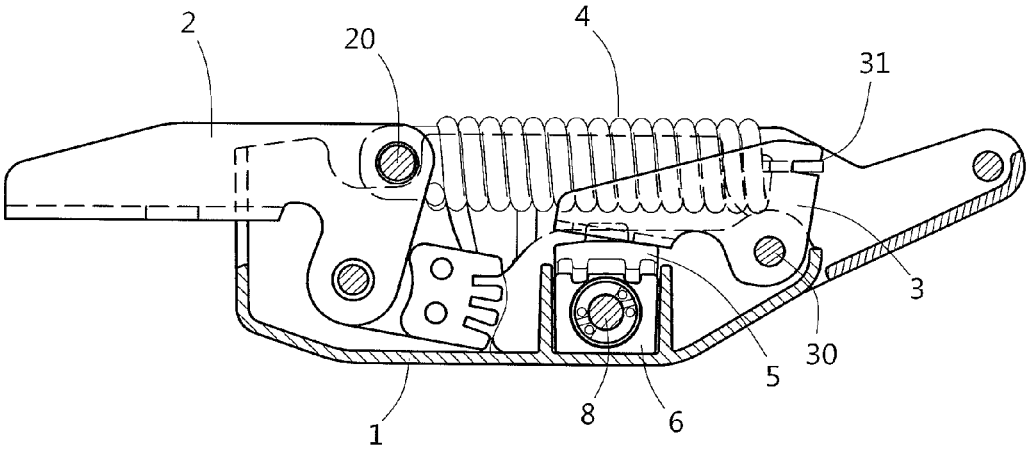
FIG. 8 is a schematic drawing showing a spring tensioned when the operating lever of the resilient-support adjusting device of the present invention is pushed inward.

Thereby, as shown in FIG. 7 and FIG. 8, when it is desired to strengthen the resilient support of the backrest, an operator may rotate the operating lever 8 to drive the engaging member 7 to rotate by an angle, so that the toothed portions 71, 63 of the engaging member 7 and the lower abutting member 6 abut against each other while the raised portion 64 and the depressed portion 72 engage with each other, thereby stably positioning the two. The engaging member 7 pushes the lower abutting member 6 to move inward along the receiving recess 11, and the inclined abutting surface 61 of the lower abutting member 6 pushes the inclined abutting surface 51 of the upper abutting member 5, so that the upper abutting member 5 moves upward, and pushes the top of the upper abutting member 5 against the lower surface 32 of the spring-tensioning brace 3, thereby driving the spring-tensioning brace 3 to swing and tension the spring 4. As a result, the backrest-fastening seat 2 generates a more pressing drawing force, so the backrest has its resilient support more tensioned and stronger. By rotating the operating lever 8 by an angle more, the toothed portions 71, 63 of the engaging member 7 and the lower abutting member 6 engage with each other again. Due to the tensioned spring 4, the upper abutting member 5 is moved downward to make the lower abutting member 6 move outward along the receiving recess 11, so that the spring-tensioning brace 3 swings to its initial position, thereby making the backrest-fastening seat 2 generate a weaker drawing force.

Thus, when a sitter lies his/her back on the backrest, he/she can feel different levels of resilient support. In operation, each time the operating lever 8 is rotated by 180 degrees, the resilient support is switched between a higher level and a lower level. As compared with the step-less adjustment used in the prior art, the present invention supports a more convenient and quicker adjustment, and the difference between the levels of resilient support is more perceptible to the sitter, so that the sitter can easily choose the level of resilient support suitable to his/her needs.

Furthermore, the toothed portions 63,71 of the lower abutting member 6 and the engaging member 7 can be designed to be a toothed portion having two or three stages (not shown), so that each time the operating lever 8 is rotated by 90 degrees or 60 degrees, a change of the level of resilient support is provided, thereby making the options of levels of resilient support be three or four instead of two, and allowing a sitter to get the level of resilient support more suitable to his/her needs.

What is claimed is:

1. A resilient-support adjusting device of a chair backrest, with the resilient-support adjusting device comprising a base adapted to be mounted on a gas spring of a leg portion of a chair, and a backrest-fastening seat pivotally connected to a rear side of the base and adapted for a backrest to be installed thereon, wherein the backrest-fastening seat is drawn by a spring to make the backrest generate a resilient support, wherein the base has a front side pivotally connected to one end of a spring-tensioning brace, wherein the spring has an end hung at a center of the spring-tensioning brace, wherein the base corresponding to an opposite end of the spring-tensioning brace contains upper and lower abutting members that have inclined abutting surfaces abutting against each other, wherein the upper abutting member has an upper end abutting against a corresponding end of the spring-tensioning brace, wherein the lower abutting member has an engaging member formed at a lateral surface thereof to be received in the base to allow the upper and lower abutting members to abut against each other, wherein toothed portions are provided where the upper and lower abutting members abut against each other and are configured to engage with each other or abut against each other upon rotation of the engaging member, to displace the lower abutting member and move the upper abutting member vertically, thereby driving the spring-tensioning brace to swing front and back, and making the spring to draw the backrest-fastening seat with different levels of tension.

2. The backrest resilient-support adjusting device of claim 1, wherein the base contains a receiving recess for receiving the upper and lower abutting members, and for guiding the lower abutting member to slide front and back and guiding the upper abutting member to slide up and down.

3. The backrest resilient-support adjusting device of claim 2, wherein the upper abutting member has a back side provided with a guiding groove, and wherein the receiving recess has a wall provided with a guiding ridge that corresponds to and matches the guiding groove.

4. The backrest resilient-support adjusting device of claim 1, wherein the inclined abutting surfaces of the upper abutting member and the lower abutting member are provided with corresponding guiding ridges and guiding grooves that match and are slidable with respect to each other.

5. The backrest resilient-support adjusting device of claim 1, wherein the toothed portions of the engaging member and the lower abutting member are provided, at a tooth top and a tooth valley, respectively, with a raised portion and a depressed portion that engage with and are positioned by each other.

6. The backrest resilient-support adjusting device of claim 1, wherein the engaging member has an outer surface provided with a rabbet, wherein an operating lever is inserted into the base, the engaging member and the lower abutting member, and wherein an engaging rod is radially inserted into the operating lever and received in the rabbet.

* * * * *